US006113495A

United States Patent [19]

Walker et al.

[11] Patent Number: 6,113,495

[45] Date of Patent: Sep. 5, 2000

[54] ELECTRONIC GAMING SYSTEM OFFERING PREMIUM ENTERTAINMENT SERVICES FOR ENHANCED PLAYER RETENTION

[75] Inventors: Jay S. Walker, Ridgefield; James A. Jorasch, Stamford; Thomas M. Sparico, Riverside, all of Conn.

[73] Assignee: Walker Digital, LLC, Stamford, Conn.

[21] Appl. No.: 08/814,889

[22] Filed: Mar. 12, 1997

[51] Int. Cl.[7] ..... A63F 9/22

[52] U.S. Cl. ..... 463/42; 463/16; 463/25

[58] Field of Search ..... 463/25, 42, 40, 463/16, 20, 30

[56] References Cited

U.S. PATENT DOCUMENTS

| | | | |
|---|---|---|---|
| 4,926,327 | 5/1990 | Sidley | 463/13 |
| 5,237,157 | 8/1993 | Kaplan | 235/375 |
| 5,259,613 | 11/1993 | Marnell, II | 463/42 |
| 5,429,361 | 7/1995 | Raven et al. | 463/42 |
| 5,488,411 | 1/1996 | Lewis | 348/8 |
| 5,530,852 | 6/1996 | Meske, Jr. et al. | 709/206 |
| 5,550,561 | 8/1996 | Ziarno | 345/163 |
| 5,590,197 | 12/1996 | Chen et al. | 380/24 |
| 5,592,212 | 1/1997 | Handelman | 463/25 |
| 5,592,375 | 1/1997 | Salmon et al. | 705/7 |
| 5,594,661 | 1/1997 | Bruner et al. | 709/219 |
| 5,638,426 | 6/1997 | Lewis | 379/90.01 |
| 5,675,828 | 10/1997 | Stoel et al. | 463/42 |
| 5,752,882 | 5/1998 | Acres et al. | 463/42 |
| 5,761,647 | 6/1998 | Boushy | 463/25 |

OTHER PUBLICATIONS

RePlay Magazine; Encyclopedia Of Pinball Ball Volume 1, Richard Bueschel, p. 146, Jan. 1997.

RePlay Magazine; the Internet Goes Mainstream, p. 179–183, Mar. 1997.

http://www.rtd.com:80/people/rawn/kiosk–paper.html; Suggestions for Information Kiosk System using the World Wide Web; The World Wide Web Information Kiosks Special Interest Group; Apr. 30, 1994.

http://www.inc.com/incmagazine/archives/16960191.html; *Street Cruising*, Schafer, Sarah, Inc. Technology, No. 2 for 1996, p. 19.

http://embed.com:80/coinet.html; *The Public Access Internet Browser*, by Two Bit Computing, Austin, Texas.

http://www.netaccessinc.com/index.html; Net Acess, Inc.

(List continued on next page.)

*Primary Examiner*—Michael O'Neill
*Assistant Examiner*—James Schaaf
*Attorney, Agent, or Firm*—Patrick J. Buckley; Dean Alderucci

[57] ABSTRACT

An electronic gaming system is disclosed that allows a player of an electronic gaming device, such as a slot machine or an arcade video game, to access premium entertainment services, such as premium web sites, pay-per-view services and shared-revenue telephone services, such as 900 or 976 services, for enhanced player retention. When play is initiated, a predefined establishment-specific criteria is evaluated to determine whether the player should be offered access to premium content entertainment services. A player entitled to access such services is preferably presented with a list of available premium entertainment services. Upon receipt of the player's selection, a connection is established between the electronic gaming device and the provider of the selected premium entertainment service. The player's level of play is preferably monitored to ensure that the establishment-specific criteria for maintaining access to such services is being met. If the establishment-specific criteria for maintaining access is not being met, a disconnection warning is preferably transmitted to the player with information on how the connection can be maintained by the player. An entry of each connection session is preferably made in a connection record database.

39 Claims, 10 Drawing Sheets

OTHER PUBLICATIONS

Christiansen, Gaming and entertainment—an imperfect union? Cornell Hotel & Restaurant Administration Quarterly, vol. 36, No. 2, (Apr. 1995), p. 79.

COMLINE Daily News Computers, Takasage Denki to Offer Video–On–Demand Game Machines, Apr. 4, 1995.

Evenson, Back in the Game, San Francisco Chronicle, Aug. 23, 1996, p. D1.

Price, Connected: Kiosks get off to a slow start, The Daily Telegraph, Feb. 4, 1997, p. 6.

Roger, tpNet ready to help in the hunt for NZ products, The Press, Jul. 23, 1996, p. 24.

Denton, British Telecom launches public online booths, The Financial Post, Oct. 29, 1996, section 1, p. 10.

Miller, Terminal is set up for public use, Santa Cruz Sentinel, Sep. 29, 1996, p. D1.

The Herald, Internet pub scorns the café 'anoraks', Dec. 2, 1996, p. 4.

PLAYER TRACKING DATABASE 400

| | PLAYER TRACKING NUMBER 420 | CASINO RATING 425 | RECENT GAMING ACTIVITY INFORMATION 430 | CURRENT BALANCE OF REWARD POINTS 435 | CONTENT PREFERENCE 440 |
|---|---|---|---|---|---|
| 410 | | | | | |
| 411 | | | | | |
| 412 | | | | | |

FIG. 4

CONTENT DATABASE 500

| | PREMIUM ENTERTAINMENT SERVICE 520 | CONTENT PROVIDER 525 | ACCESS INFORMATION 530 | ACCOUNT NUMBER 535 | PASSWORD 540 | COST 545 |
|---|---|---|---|---|---|---|
| 510 | | | | | | |
| 511 | | | | | | |
| 512 | | | | | | |

FIG. 5

CONNECTION RECORD DATABASE 600

| | CONNECTION ID NUMBER 620 | PLAYER TRACKING NUMBER 625 | DATE 630 | TIME 635 | CONNECTION DURATION 640 | CONTENT PROVIDER 645 | COST 650 |
|---|---|---|---|---|---|---|---|
| 610 | | | | | | | |
| 611 | | | | | | | |
| 612 | | | | | | | |

FIG. 6

ELECTRONIC GAMING SYSTEM OFFERING PREMIUM ENTERTAINMENT SERVICES FOR ENHANCED PLAYER RETENTION

FIELD OF THE INVENTION

The present invention relates generally to a system for increasing the utilization of electronic gaming devices, such as slot machines or arcade video games, by providing players with an additional incentive for continued play, and more particularly, to a system for allowing players of electronic gaming devices, such as slot machines, to access premium entertainment services, such as premium web sites, pay-per-view services and shared-revenue telephone services, directly from the electronic gaming device.

BACKGROUND OF THE INVENTION

Slot machines, such as video poker, video keno or video blackjack devices (hereinafter, collectively referred to as "slot machines") or other electronic gaming devices, such as arcade video games, are an important source of income for the gaming industry and arcades. Accordingly, many casinos and arcades constantly search for marketing strategies and programs to appeal to players and to distinguish their electronic gaming devices from competitors in the industry. For example, as an added incentive to play the slot machines, many casinos offer "slot club" programs to reward slot machine players. Each player in a slot club is generally issued a player tracking card encoded with his identification number. The casino awards "player reward points" for the player as he plays slot machines in that casino. The "player reward points" can generally be redeemed for merchandise or services at the casino hotel. In many cases, however, these incentives may not be sufficient to attract new players or to retain existing casino players at slot machines.

Thus, a number of programs have been implemented or suggested in an attempt to retain players at slot machines and other electronic gaming devices. For example, many casinos provide players with various forms of entertainment and services directly at the slot machine. U.S. Pat. No. 5,259,613, entitled "Casino Entertainment System", discloses an entertainment system for slot players in a casino which includes audio/video equipment at each slot machine for communicating with a central control station. The operator at the central station selects audio/video programming from a menu of available selections, for presentation at one or more of the slot machines in the casino. The available audio/video programming is obtained from a number of conventional sources, including a VCR, an audio tape deck, a live camera or microphone and commercial television broadcasting sources, including cable television programming.

Unfortunately, such conventional casino and arcade entertainment systems have experienced only marginal success in retaining players at slot machines and other electronic gaming devices. Since many players can already access a wide variety of programming sources directly from their home, the current video programming is generally not a sufficient novelty to keep a player playing at a slot machine.

In addition, it is well known that many hotels and casinos provide their guests with a variety of "in room"entertainment services, including pay-per-view video programming. See, for example, U.S. Pat. No. 5,488,411, entitled "Interactive System for a Closed Cable Network" (the "'411 Patent"), which describes a video-on-demand system, for use in a hotel or hospital environment. The '411 Patent discloses a system having a connection to each hotel room for presentation of various multimedia information, including premium pay-per-view services from remote sources. In addition to connecting guests to remote pay-per-view sources, a guest can access a gaming device, such as a video slot machine, for play from their private room via the closed cable network. The system disclosed in the '411 Patent, however, does not permit a guest to simultaneously access such gaming devices, while viewing a premium pay-per-view service.

As apparent from the above-described deficiencies with conventional systems for retaining players at electronic gaming devices, such as slot machines, a need exists for an electronic gaming system that allows players to access premium entertainment services, such as premium web sites, pay-per-view services and shared-revenue telephone services, such as 900 or 976 services, directly from the slot machine or other electronic gaming device as an incentive for continued play. In addition, a further need exists for an electronic gaming system which evaluates the current level of play or prior playing history of a particular player for determining whether the player is entitled to access the premium entertainment services. Yet another need exists for a publicly accessible electronic gaming system which permits coins to be deposited as payment for access to a premium entertainment service, regardless of whether or not the player is actually playing the electronic gaming device.

SUMMARY OF THE INVENTION

Generally, according to one aspect of the invention, a player will be permitted to access premium entertainment services, such as premium web sites, pay-per-view services and shared-revenue services, such as 900 or 976 services, directly from the slot machine or other electronic gaming device for as long as the player meets the entitlement requirements established by the casino or arcade, discussed below, for accessing such premium entertainment services (the "establishment-specific criteria").

In one embodiment, each slot machine or electronic gaming device accesses the premium entertainment services via a centralized network server. When the network server is notified that play has commenced at a particular slot machine or other electronic gaming device, the network server preferably evaluates establishment-specific criteria to determine whether the player should be offered access to premium content entertainment services while playing. In one illustrative embodiment, the establishment-specific criteria can offer access to the premium content entertainment services on the following basis: (i) unlimited complimentary usage to all players whose prior playing history meets predefined criteria, (ii) unlimited complimentary usage to all players on certain classes or types of electronic gaming devices, (iii) limited complimentary access to those players whose current level of play meets or exceeds a predefined threshold, or (iv) access in exchange for a cash payment or player reward points awarded as part of a slot club or an arcade incentive program, regardless of any current level of play.

If the establishment-specific criteria for offering the player the premium entertainment services is met, a menu of the available premium entertainment services is preferably transmitted to the slot machine or other electronic gaming device for display to the player. The player thereafter enters his selection of a desired premium entertainment service, which selection is transmitted to the network server. Upon receipt of the player's selection, a content database is preferably accessed to retrieve information required by the network server to access the selected content provider, such as the appropriate external network and network address to be utilized, as well as any required account number and/or password. A connection is thereafter established by the network server between the electronic gaming device and the selected content provider.

Once the connection to the selected premium entertainment service is established, the network server preferably monitors the player's level of play to determine if the establishment-specific criteria for maintaining access to the selected premium entertainment service is being met. As previously indicated, in an illustrative embodiment, the establishment-specific criteria will maintain the premium entertainment services for (i) all players on certain classes of electronic gaming devices, regardless of the player's current level of play; (ii) certain players based on their prior playing history, regardless of the player's current level of play, (iii) for those players whose current level of play meets or exceeds a predefined threshold, and (iv) for those players who provide a cash payment or player reward points awarded as part of a slot club or an arcade incentive program.

If the establishment-specific criteria for maintaining the premium entertainment service is not being met, a disconnection warning is preferably transmitted to the player with information on how the connection to the premium entertainment service can be maintained by the player. For example, the player can maintain the connection to the premium entertainment service by (i) complying with the casino's (or arcade's) level of play requirements to maintain complimentary access; (ii) depositing coins in the electronic gaming device or otherwise providing an additional payment; or (iii) allowing a deduction of earned credits from current play prizes or player reward points.

After receiving the disconnection message, the connection to the premium entertainment service will preferably be terminated if the player does not perform one of the indicated steps for maintaining the connection. Once the connection is terminated, an entry of the connection session is preferably made in a connection record database.

A more complete understanding of the present invention, as well as further features and advantages of the present invention, will be obtained by reference to the following detailed description and drawings.

BRIEF DESCRIPTION OF DRAWINGS

FIG. 4 illustrates a sample table from the player tracking database of FIG. 2;

FIG. 5 illustrates a sample table from the content database of FIG. 2;

FIG. 6 illustrates a sample table from the connection record database of FIG. 2;

DETAILED DESCRIPTION

Figure 1:
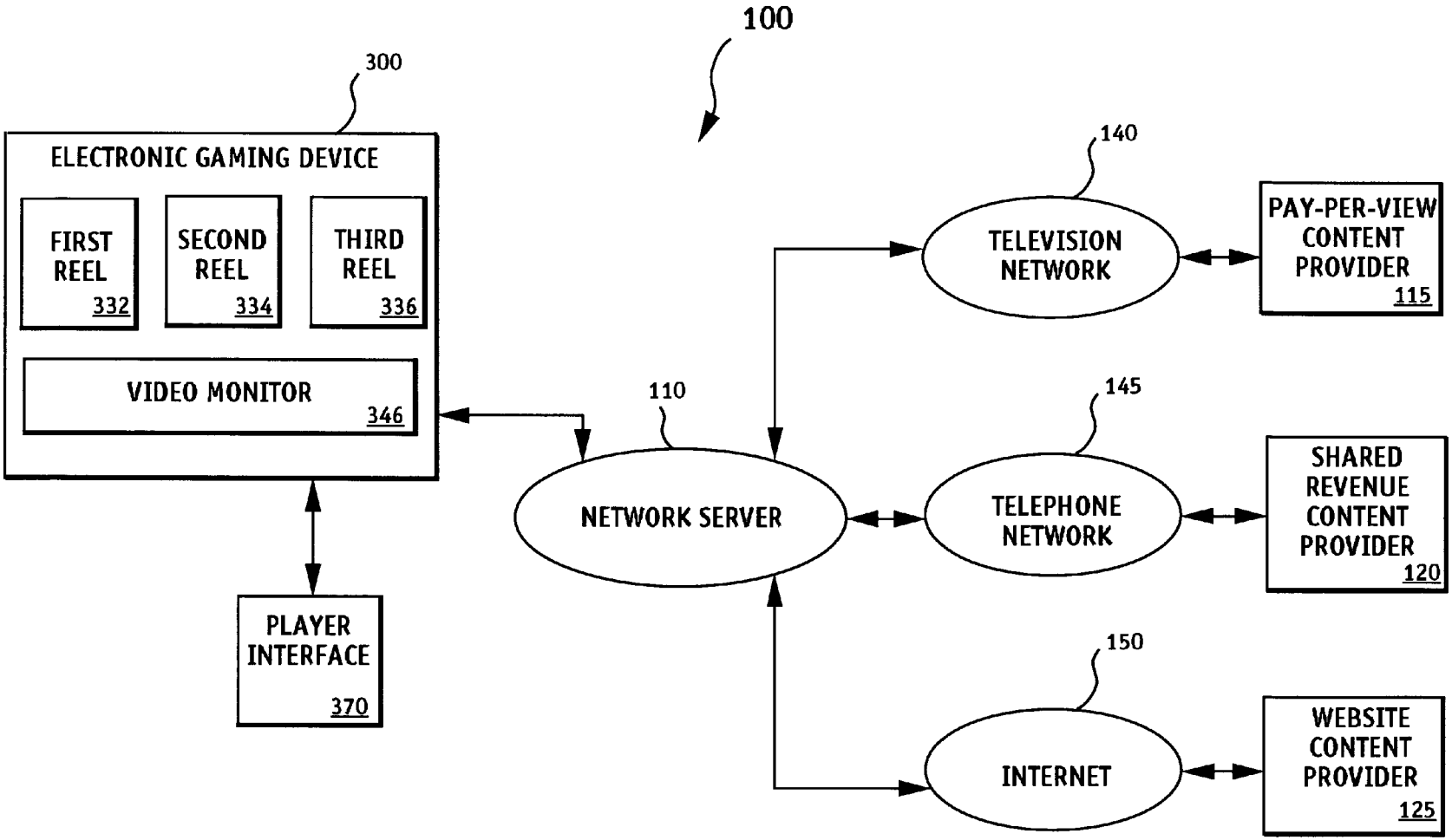
FIG. 1 is a schematic block diagram illustrating a suitable communications network for interconnecting an electronic gaming device, such as a slot machine, with one or more premium entertainment services.

FIG. 1 shows an illustrative network environment for transferring multimedia information, such as video, audio and data, between a content provider, such as content providers 115, 120, 125, and one or more electronic gaming devices, such as slot machine 300, over one or more external networks 140, 145, 150. According to a feature of the present invention, the content providers, such as providers 115, 120 and 125, provide players with access to premium entertainment services. A premium entertainment service, as used herein, is a service for which a fee is specifically charged for the use of that service, including premium web sites, pay-per-view services and shared-revenue telephone services, such as 900 or 976 services. It is noted that the fee incurred for a particular premium entertainment service may be a fixed fee for a predefined period of time (in other words, a flat monthly fee), or a variable rate based on the amount of usage of the premium entertainment service.

According to a further feature of the invention, discussed below, access to the premium entertainment services can be provided to a player on a complimentary basis, as an incentive for continued play, as a prize in lieu of, or in addition to, a cash payout, or in exchange for a cash payment or player reward points awarded as part of a slot club or an arcade incentive program.

The term "slot machine" as used herein refers to any programmable gaming terminal controlling a random or pseudo-random event in which one or more players can bet on the outcome of the event, including traditional slot machines, video bingo, video keno, video poker and video blackjack devices. The term "electronic gaming device" as used herein refers to a slot machine or an arcade video game, such as Mortal Kombat, NBA Jam, or Virtua Fighter. While the electronic gaming device 300 is illustrated as a slot machine in the embodiment shown in FIG. 1 and discussed herein, another electronic gaming device, such as a video arcade game, could be substituted therefor, as would be apparent to a person of ordinary skill. In the illustrative embodiment shown in FIG. 1, the slot machine 300 accesses the external networks 140, 145, 150, indirectly via a network server 110, discussed further below in conjunction with FIG. 2. It is noted that the functionality provided by the network server 110 for connecting the slot machine 300 to the remote content providers 115, 120, 125, as discussed below, could be provided directly in the slot machine 300 itself, as would be apparent to a person of ordinary skill. In this manner, a slot machine 300 could directly access a desired content provider 115, 120, 125, via the external networks 140, 145, 150. The network server 110 and the slot machine 300 (or another electronic gaming device), discussed further below in conjunction with FIGS. 2 and 3, respectively, may comprise conventional hardware and software, as modified herein to carry out the functions and operations described below.

The network server 110 and slot machine 300 transmit digitally encoded data and other information between one another. The transmitted data and other information may represent player name and identification number, play results, authenticated player identification, a menu of premium entertainment services and player selections, and the multimedia premium entertainment service content. The communications link between the network server 110 and the slot machine 300 preferably comprises a cable or wireless link on which electronic signals can propagate. Although FIG. 1 shows only one slot machine 300, a plurality of slot machines or other electronic gaming devices are typically connected to a network server 110, each identified by a unique machine identification number. It is noted that each content provider, such as content providers 115, 120, 125, preferably employs a general purpose computer, for communicating with the network server 110. The general purpose computer of each content provider 115, 120, 125 is preferably comprised of a processing unit, a modem, memory means and any required audio/video hardware and software.

The television network 140, as used herein, includes a wireless broadcast network for distribution of premium video programming, such as a digital satellite service ("DSS"), as well as a conventional wired cable television network ("CATV"). The premium entertainment services accessed via the television network 140 include pay-per-view video programming.

The telephone network 145, as used herein, includes the combination of local and long distance wire or wireless facilities and switches known as the public switched telephone network ("PSTN"), as well as cellular network systems and the telephony feature of the Internet. The premium entertainment services accessed via the telephone network 145 include shared-revenue telephone services, such as 900 or 976 services. As is well known, shared-revenue telephone services deliver a particular service over the telephone and subsequently bill the caller. The caller is typically identified by the phone number from which the call is made, with the subsequent bill then included as part of the caller's regular telephone bill. The content provider typically calculates the amount of the bill after the service has been delivered. This amount is forwarded to the billing telephone company, which both bills and collects the appropriate amount from the caller. The telephone company typically deducts a portion of the total fee for the service in return for both the cost of making the telephone connection and for the telephone company's role as bill collector.

The Internet network 150, as used herein, includes the World Wide Web (the "Web") and other systems for storing and retrieving information using the Internet. To view a web site, the user communicates an electronic Web address, referred to as a Uniform Resource Locator ("URL"), associated with the web site. In one preferred embodiment, the player can be presented with a list or menu of available premium web sites, with the corresponding URL preprogrammed for each site. The player thereafter enters his selection of a desired premium web site, which selection is transmitted to the network server 110. A web browser software product, such as Netscape Navigator or Microsoft Internet Explorer, then accesses the web site by communicating with the appropriate server, in a known manner. The premium entertainment services accessed via the Internet network 150 include premium web sites, such as ESPNET Sportszone.

Figure 2:
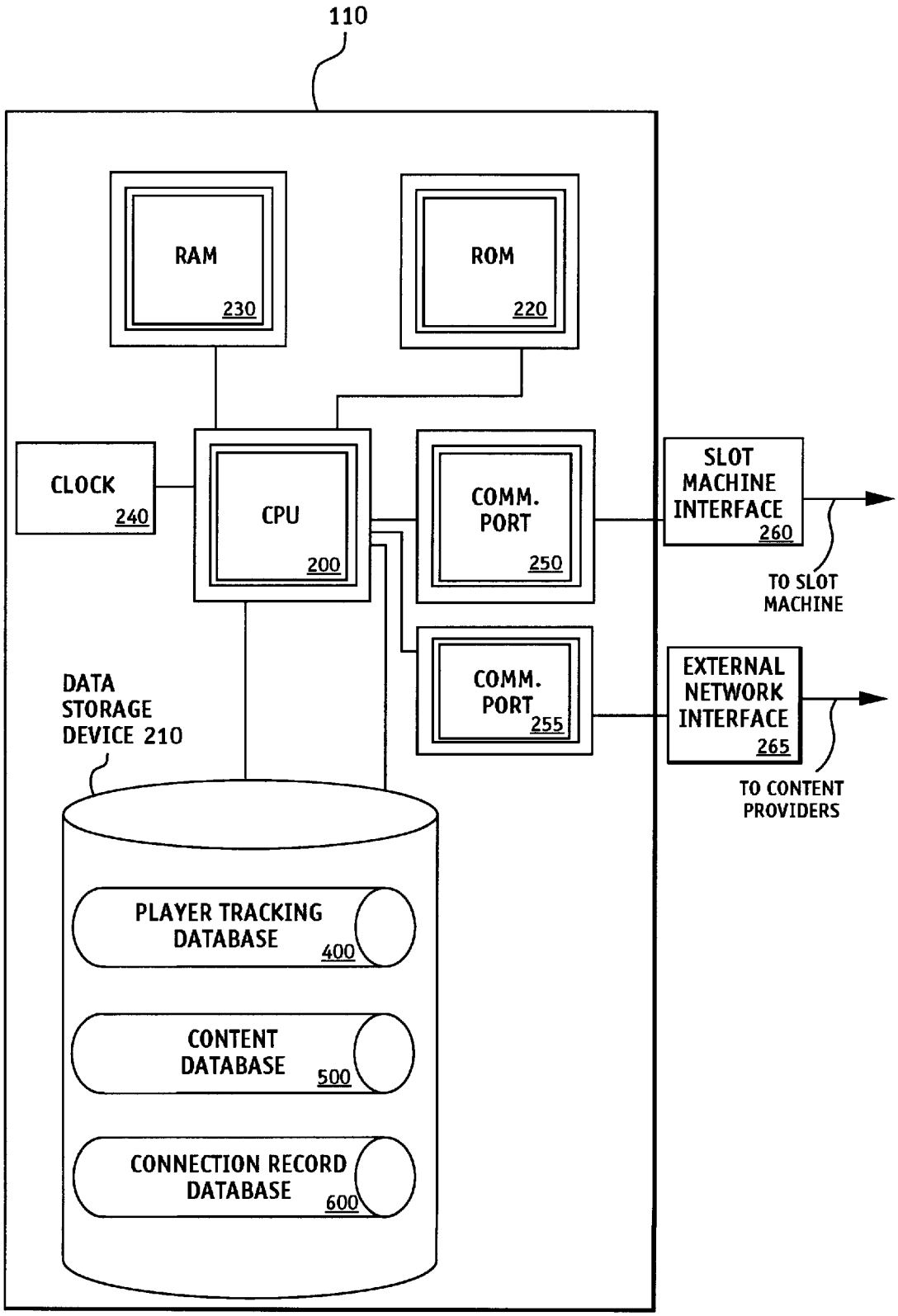
FIG. 2 is a schematic block diagram of the network server of FIG. 1.

FIG. 2 is a block diagram showing the architecture of an illustrative network server 110. The network server 110 may be embodied, for example, as an RS 6000 server, manufactured by IBM Corp., as modified herein to execute the functions and operations of the present invention. The network server 110 preferably includes certain standard hardware components, such as a central processing unit (CPU) 200, a data storage device 210, a read only memory (ROM) 220, a random access memory (RAM) 230, a clock 240, and communications ports 250, 255. The CPU 200 is preferably linked to each of the other listed elements, either by means of a shared data bus, or dedicated connections, as shown in FIG. 2.

The CPU 200 may be embodied as a single processor, or a number of processors operating in parallel. The data storage device 210 and/or ROM 220 are operable to store one or more instructions, as discussed below in conjunction with FIGS. 7A through 7C, which the CPU 200 is operable to retrieve, interpret and execute. The CPU 200 preferably includes a control unit, an arithmetic logic unit (ALU), and a CPU local memory storage device, such as, for example, a stackable cache or a plurality of registers, in a known manner. The control unit is operable to retrieve instructions from the data storage device 210 or ROM 220. The ALU is operable to perform a plurality of operations needed to carry out instructions. The CPU local memory storage device is operable to provide high speed storage used for storing temporary results and control information.

As discussed further below in conjunction with FIGS. 4 through 6, the data storage device 210 includes a player tracking database 400, a content database 500, and a connection record database 600. The player tracking database 400 preferably stores historical information on each player, including an indication of his gaming activity. The content database 500 preferably stores information required by the network server 110 for each available premium entertainment service, including information required to access the selected content provider, such as the appropriate external network and network address to be utilized, as well as any required account number and/or password. The connection record database 600 preferably stores information on each connection session made by the network server 110 to a premium entertainment service, including an indication of the duration or estimated cost of each connection session.

The communications port 250 connects the network server 110 to a slot machine interface 260, thereby linking the network server 110 to each connected slot machine, such as the slot machine 300 shown in FIG. 1. The communications port 255 connects the network server 110 to an external network interface 265, thereby linking the network server 110 to one or more external networks, such as the networks 140, 145, 150 shown in FIG. 1. The communication ports 250, 255 preferably include multiple communication channels for simultaneously connecting multiple players to multiple content providers 115, 120, 125.

Figure 3:
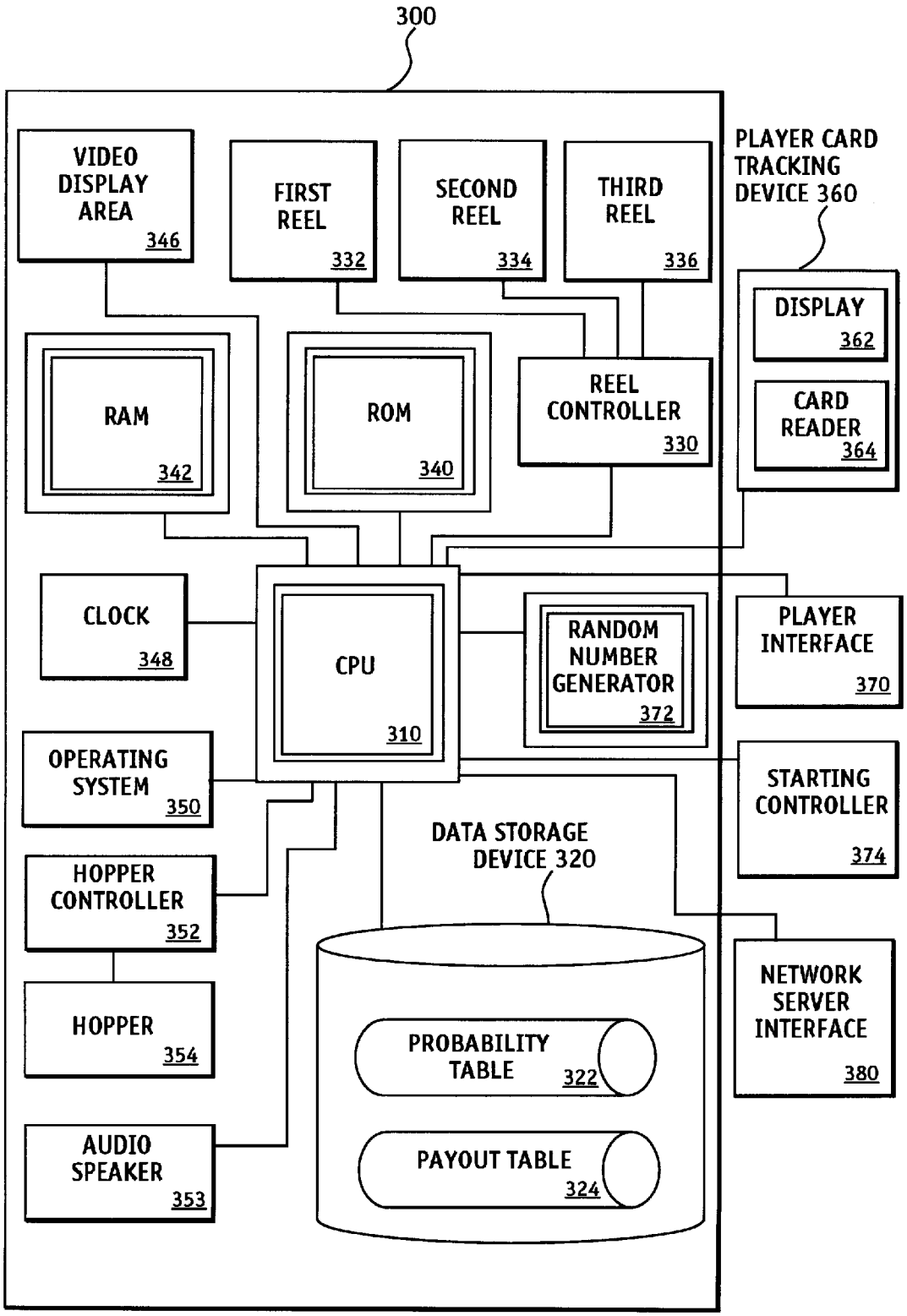
FIG. 3 is a schematic block diagram of the slot machine of FIG. 1.

FIG. 3 is a block diagram showing the architecture of an illustrative slot machine 300. The slot machine 300 preferably includes certain standard hardware components, such as a CPU 310, a data storage device 320, a ROM 340, a RAM 342, and a clock 348. The CPU 310 is preferably linked to each of the other listed elements, either by means of a shared data bus, or dedicated connections, as shown in FIG. 3. The CPU 310 executes program modules stored in the data storage device 320 or the ROM 340 to perform the processes described below, in a known manner.

With respect to gaming operations, slot machine 300 performs in a conventional manner. The player starts the slot machine 300 by providing a form of payment, for example, by depositing coins, or inserting a credit card, debit card or smart card, and pressing a starting controller 374. Under control of a program stored, for example, in the data storage device 320 or ROM 340, the CPU 310 initiates the random number generator 372 to generate a number. The CPU 310 looks up the generated random number in a stored probability table 322 and finds the corresponding outcome, or game result. Based on the identified outcome, the CPU 310 locates the appropriate payout in a stored payout table 324. The CPU 310 also directs a reel controller 330 to spin the reels 332, 334, 336 and to stop them at a point when a combination of symbols corresponding to the selected payout is displayed. When the player wins, the slot machine 300 stores the credits in a random access memory (RAM) 342 and displays the available credits in a video display area 346.

A hopper controller 352 is connected to a hopper 354 for dispensing coins. When the player requests to cash out by pushing a button on the slot machine 300, the CPU 310 checks the RAM 342 to see if the player has any credit and, if so, signals the hopper 354 to release an appropriate number of coins into a payout tray (not shown).

In alternative embodiments, the slot machine 300 does not include the reel controller 330, or reels 332, 334, 336. Instead, the video display area 346 graphically displays representations of objects contained in the selected game, such as graphical reels or playing cards. These representations are preferably animated to display playing of the selected game.

A player tracking device 360 is also in communication with the CPU 310. The player tracking device 360 comprises a card reader 364 for reading player identification information stored on a player tracking card (not shown), which is preferably encoded with information to identify the player, in a known manner. The player tracking device 360 also preferably includes a display 362, having a touch screen, or associated player interface 370. Suitable commercially available player card tracking devices include, for example, the Mastercom device available from Bally Manufacturing. (See, for example, U.S. Pat. No. 5,429,361 to Raven et al.). Such player tracking devices include a magnetic card reader and a numeric keypad for entry of player information.

The slot machine 300 also includes a network server interface 380 which provides a communication path between the slot machine 300 and the network server 110. Thus, as discussed further below, information may be communicated among the player tracking device 360, slot machine 300 and network server 110.

Once play is initiated by a player, in the manner described above, the slot machine 300 preferably displays a menu of available premium entertainment services on the display 362 or video display area 346, and prompts the player to select a desired premium entertainment service, for example, using the player interface 370.

According to a feature of the present invention, the slot machine 300 is capable of presenting premium entertainment service received from one or more content providers 115, 120, 125 to a player at the slot machine 300. As previously indicated, the premium entertainment service received from the content provider may be multimedia information, including video, audio and/or data information. Thus, the slot machine 300 is preferably capable of presenting such multimedia information to a player. Thus, in addition to the video display area 346, which may be utilized to display the video and data information, the slot machine 300 preferably includes an audio speaker or headset 353.

In a preferred embodiment, the slot machine 300 includes means for presenting the player with an integrated display of the multimedia information associated with the premium entertainment service, together with the gaming result, for example, by means of a virtual reality (VR) headset (not shown). In this manner, all of the entertainment content intended for the player, including the game result and the multimedia premium entertainment service, is presented through the VR headset. A VR headset offers particular advantages since it permits private viewing of a selected premium entertainment service in a public environment. Alternatively, a pair of glasses which are uniquely "keyed" to the output of the video display area 346, for example, by means of a particular polarization or wavelength, could be configured to provide similar privacy.

As previously indicated, the player tracking database 400, shown in FIG. 4, preferably stores historical information on each player, including an indication of their gaming activity. The player tracking database 400 maintains a plurality of records, such as records 410–412, each associated with a different player. For each player identified by player tracking number in field 420, the player tracking database 400 includes a casino rating in field 425 which may be utilized to characterize the playing history of a player. For example, the casino rating may indicate whether a given player is a "high roller." In addition, the player tracking database 400 preferably includes an indication in field 430 of the recent gaming activity of the player within a predefined historical period, and an indication in field 435 of the current balance of player reward points available to the given player.

Finally, in accordance with a feature of the present invention, the player tracking database 400 preferably includes an indication in field 440 of the player's preferences with respect to particular premium entertainment services. In this manner, the menu of available premium entertainment services which is presented to the player when play is commenced can be tailored to the indicated preferences of the particular player.

Information required by the network server 110 on each available premium entertainment service is preferably stored in the content database 500, such as the content database 500 illustrated in FIG. 5. The content database 500 maintains a plurality of records, such as records 510–512, each associated with a different premium entertainment service. For each premium entertainment service option listed in field 520, the content database 500 includes an indication in field 525 of the appropriate content provider, such as the content provider 125, that provides the respective premium entertainment service. In addition, the content database 500 preferably contains any information which is required to access each premium entertainment service. In one embodiment, the content database 500 stores access information in field 530, an account number in field 535 and a password in field 540.

For example, if a particular premium entertainment service is a premium web site, the access information stored in field 530 may indicate that the web site is accessed via the Internet 150, and may contain the appropriate URL address. Similarly, if a premium entertainment service is a shared-revenue telephone service, the access information stored in field 530 may indicate that the shared revenue telephone service is accessed via the telephone network 145, and contain the appropriate 900 or 976 telephone number. Finally, if the premium entertainment service is a pay-per-view movie selection, the access information may indicate that the pay-per-view movie is accessed via a cable (or wireless) television network, such as the network 140, and contain the appropriate cable television channel number.

In one embodiment, the content database 500 also includes cost information in field 545 for each premium entertainment service which thereby permits the casino to maintain estimated cost information for each connection session and to also implement variable per minute rates for one or more premium entertainment services.

As previously indicated, the network server 110 preferably maintains a connection record database 600, shown in FIG. 6, for storing information on each connection session to a premium entertainment service. The connection record database 600 maintains a plurality of records, such as the records 610–612, each associated with a different connection session made by the network server 110 to a premium entertainment service. For each connection session listed in field 620, the connection record database 600 preferably stores the player tracking number of the player who requested the connection in field 625, and the date, time and duration of the connection in fields 630, 635 and 640, respectively. In addition, the connection record database 600 preferably records an indication of identity of the content provider that provides the premium entertainment service associated with the connection in field 645 and an indication of the estimated cost of the connection in field 650. In this manner, the casino has recorded the appropriate information which may be required to verify any contested charges.

As discussed further below in conjunction with FIGS. 7A through 7C, the processes performed by the network server 110, in the illustrative embodiment, require the network server 110 to interact with one or more electronic gaming devices, such as slot machine 300, and one or more content providers, such as the content providers 115, 120, 125. Generally, when the network server 110 is notified that play has commenced at a particular electronic gaming device, the network server 110 preferably evaluates establishment-specific criteria to determine whether the player should be offered access to premium content entertainment services while playing. It is again noted that the functionality provided by the network server 110, including the programs described below in conjunction with FIGS. 7A through 7C, could be performed directly by a slot machine 300 or another electronic gaming device, as would be apparent to a person of ordinary skill.

Figure 7A:
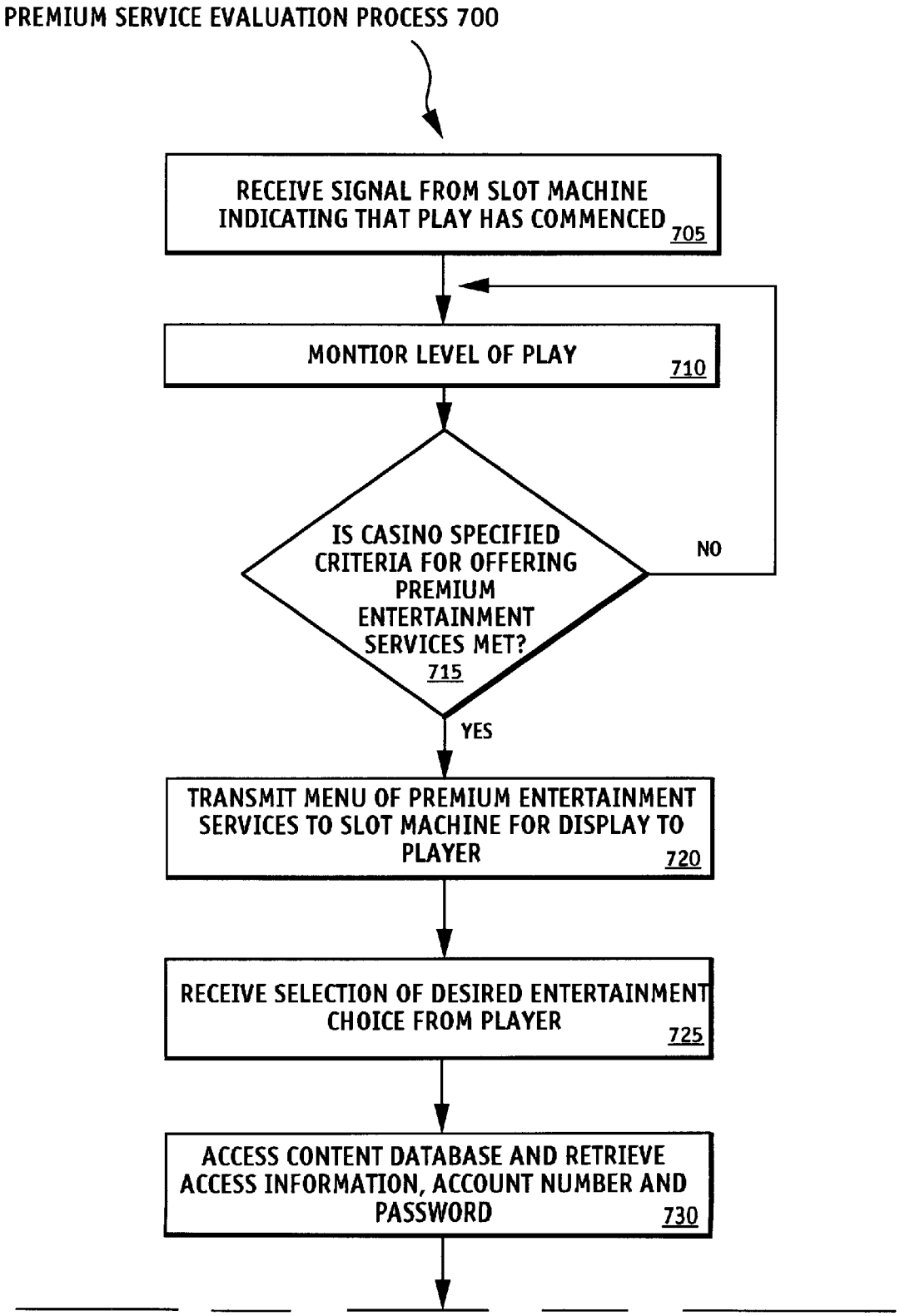
FIGS. 7A through 7C, collectively, are a flow chart describing an exemplary premium content evaluation process implemented by the network server processor of FIG. 2 in the illustrative embodiment.
Figure 7B:
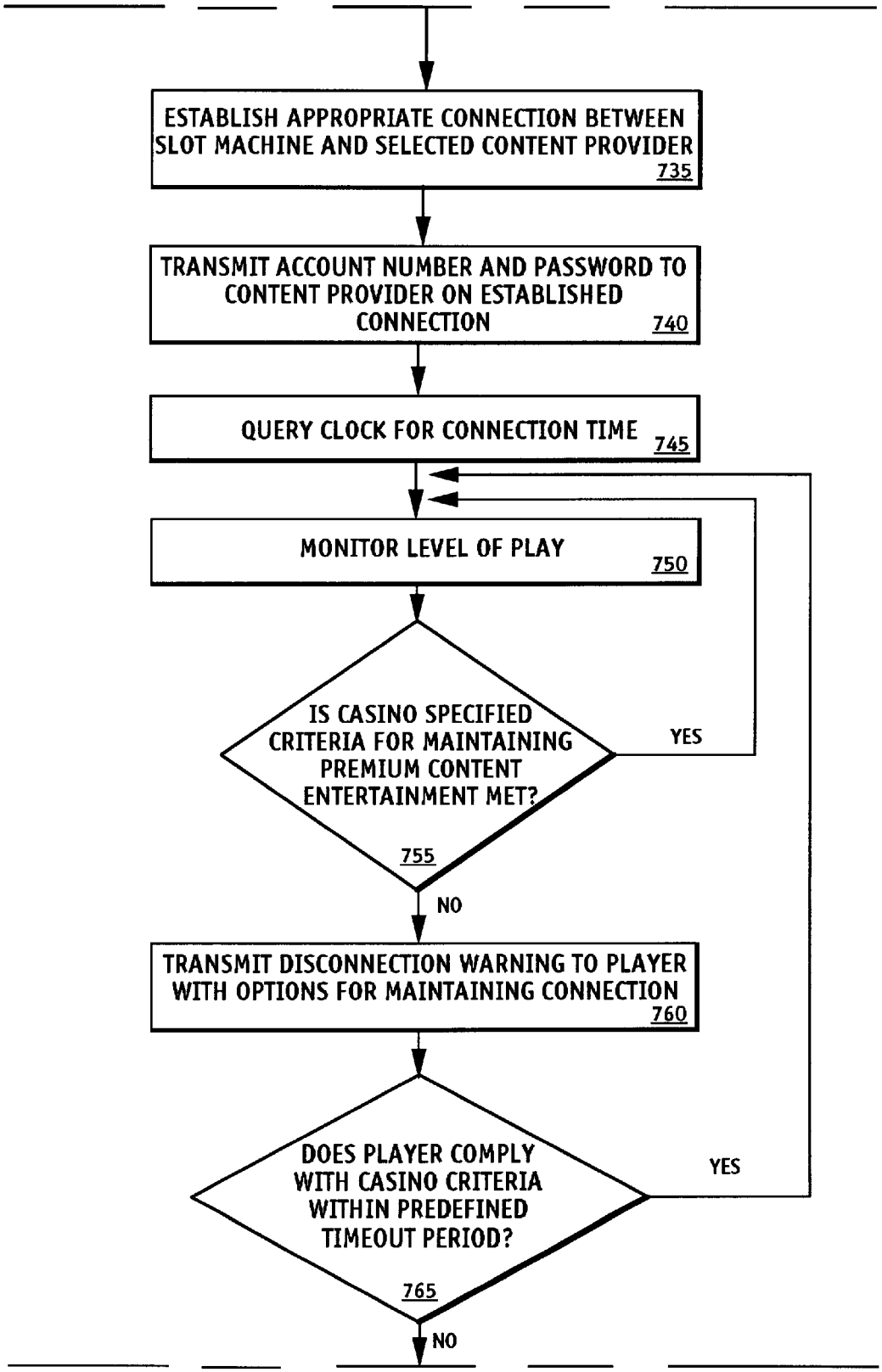
Figure 7C:
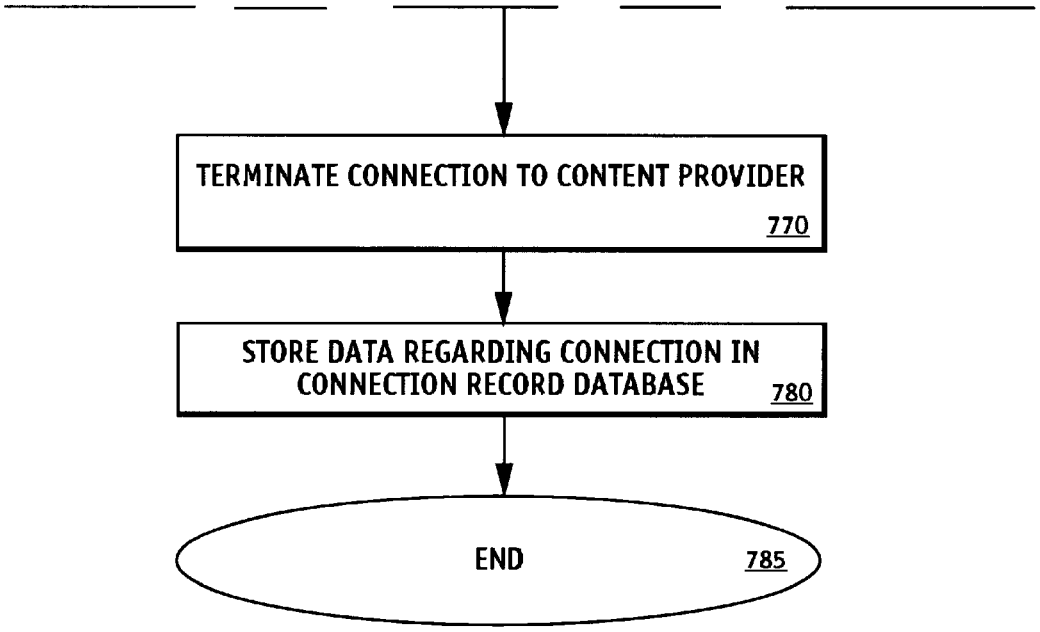

As illustrated in FIG. 7A, the network server 110 begins the processes embodying the principles of the present invention during step 705, upon initiation of play at an electronic gaming device, such as slot machine 300, and receipt by the network server 110 of an indication that such play has commenced. The network server 110 initially monitors the level of play during step 710 to determine whether this player is entitled to access the premium entertainment services.

Thus, a test is performed during step 715 to determine if the casino-specified criteria for offering players access to the premium entertainment services is met. For example, in one illustrative embodiment, the establishment-specific criteria can offer access to the premium content entertainment services on the following basis: (i) unlimited complimentary usage to all players whose prior playing history meets predefined criteria, as determined, for example, by accessing the player tracking database 400, (ii) unlimited complimentary usage to all players on certain classes or types of electronic gaming devices, as determined by accessing a record maintained by the network server 110 identifying the machine type for each electronic gaming device, (iii) limited complimentary access to those players whose current level of play meets or exceeds a predefined threshold, as determined by monitoring the current level of play of each player, or (iv) access to those players who provide a cash payment or player reward points awarded as part of a slot club or an arcade incentive program, regardless of any level of play. It is noted that a casino can evaluate the current level of play based on a number of criteria, including the number of coins played by the player per hour, how much money the player has won, how long the player has played or how many coins the player started out with.

If it is determined during step 715 that the casino-specified criteria for offering players access to the premium entertainment services is not met, program control returns to step 710, and the network server 110 continues monitoring the player's level of play until the casino-specified criteria for offering players access to the premium entertainment services is met.

Thus, once it is determined during step 715 that the casino-specified criteria for offering players access to the premium entertainment services is met, program control proceeds to step 720, where the network server 110 transmits a menu of the available premium entertainment services to the slot machine 300 for display to the player. In a preferred embodiment, the player's content preferences are retrieved from the player tracking database 400, and the menu of available premium entertainment services is tailored to the preferences of the individual. Thereafter, the network server 110 preferably waits until a selection of the desired entertainment choice is received from the player during step 725.

Upon receipt of the desired entertainment choice, the network server 110 accesses the content database 500 during step 730 and retrieve any access information, account number, and/or password which is required to access the selected premium entertainment service, including the appropriate external network to be utilized; any required network address (Internet), telephone number (shared revenue telephone services) or cable channel (pay-per-view); and any required account number and/or password. For example, if the player has selected a web site-based premium entertainment service provided by content provider 125, which is accessed via the Internet 150, the network server 110 accesses the appropriate record of the content database 500 and retrieve the appropriate stored access information, including the URL address associated with the web site.

Thereafter, during step 735 (FIG. 7B), the network server 110 utilizes the information retrieved during the previous step to establish the appropriate connection between the slot machine 300 and the selected content provider, such as content provider 125. For example, if the player has selected a web site-based premium entertainment service provided by content provider 125, which is accessed via the Internet network 150, the network server 110 preferably enters the URL in a web browser, such as Netscape, to access the desired web site.

Once the connection is established to the selected content provider during step 735, such as the web-based content provider 125, the account number and password, if any, retrieved during step 730, are preferably transmitted to the content provider 125 during step 740. Thereafter, the network server 110 preferably queries the clock 240 during step 745 to determine the time at which the connection is initially established.

The network server 110 preferably resumes monitoring the level of play during step 750 to determine whether the current level of play is sufficient to maintain this player's access to the premium entertainment services. Thus, a test is performed during step 755 to determine if the casino-specified criteria for maintaining access to the premium entertainment services is met. For example, in the illustrative embodiment, the establishment-specific criteria will maintain the premium entertainment services for (i) all players on certain classes of electronic gaming devices, regardless of the player's current level of play; (ii) certain players based on their prior playing history, regardless of the player's current level of play, (iii) for those players whose current level of play meets or exceeds a predefined threshold, and (iv) for those players who provide a cash payment or player reward points awarded as part of a slot club or an arcade incentive program.

If it is determined during step 755 that the casino-specified criteria for maintaining access to the premium entertainment services is currently being met, program control returns to step 750, and the network server 110 continues monitoring the player's level of play until the casino-specified criteria for offering players access to the premium entertainment services is no longer being met, or until play is terminated.

Once it is determined step 755 that the casino-specified criteria for offering players access to the premium entertainment services is no longer being met, program control proceeds to step 760, where the network server 110 transmits a disconnection warning to the slot machine 300 for display to the player. The disconnection warning preferably includes options for maintaining the connection to the selected content provider 125. In one illustrative embodiment, the disconnection warning can indicate that the player can maintain the connection to the premium entertainment service by (i) complying with the casino's level of play requirements to maintain complimentary access (the establishment-specific criteria); (ii) depositing coins in the electronic gaming device or otherwise providing an additional payment, for example, by means of a credit card, debit card or smart card; or (iii) allowing a deduction of earned credits from current slot play prizes or player reward points.

Thereafter, a test is performed during step 765 to determine if the player has complied with the casino-specified criteria for maintaining the connection within a predefined timeout period. Thus, if it is determined during step 765 that the player has complied with the casino-specified criteria for maintaining the connection within a predefined timeout period, program control returns to step 750, and the network server 110 continues monitoring the player's level of play until the casino-specified criteria for offering access to the premium entertainment services is again no longer being met, or until play is terminated.

If, however, it is determined during step 765 that the player has failed to comply with the casino-specified criteria for maintaining the connection within a predefined timeout period, program control proceeds to step 770 (FIG. 7C), where the network server 110 disconnects the connection to the selected content provider 125. The network server 110 preferably creates a record of the connection in the connection record database 600 during step 780. As previously indicated, this record may be utilized to confirm any billing information received from the content provider 125. Thereafter, the network server 110 exits the process during step 785 to wait for the next play session which may be entitled to access a premium entertainment service.

The casino is preferably billed by each content provider for the total connection time on each slot machine. The billing information can be verified using the connection record database 500.

Figure 8:
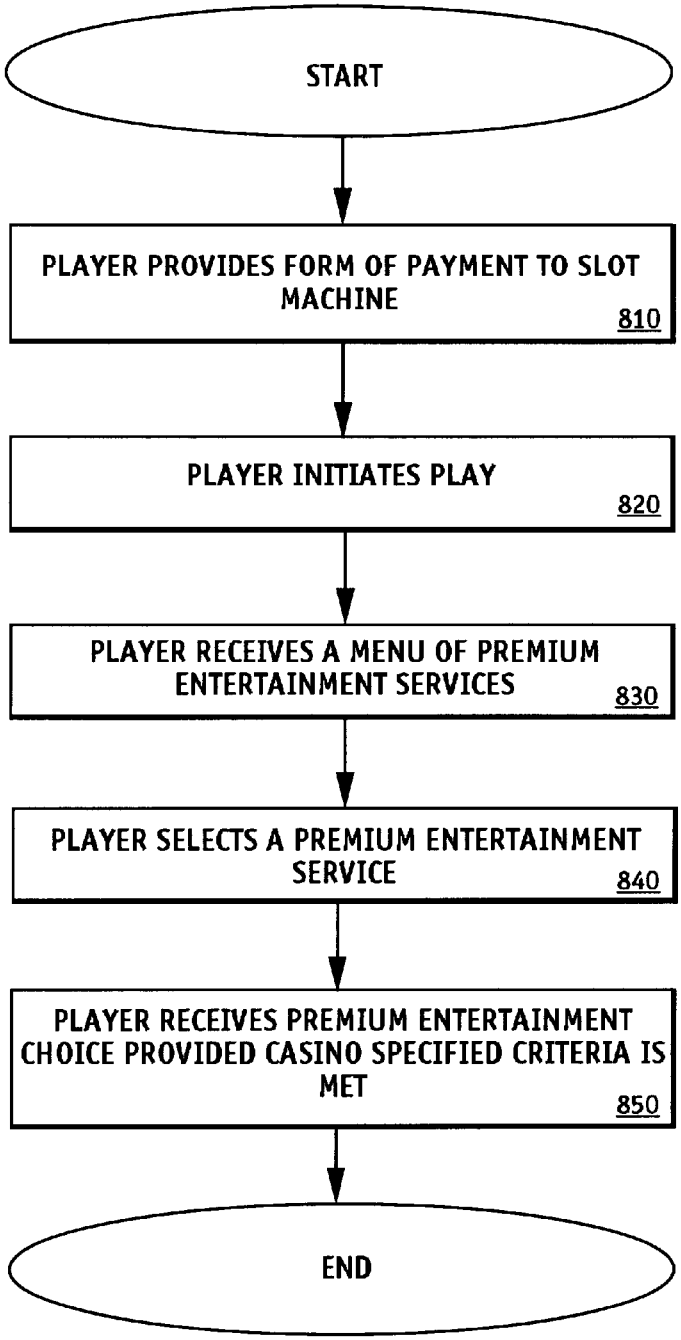
FIG. 8 is a flow chart describing an exemplary player process.

An exemplary process from the point of view of a player is shown in FIG. 8. As shown in FIG. 8, a player initiates the process during step 810 by providing a form of payment to a slot machine 300, for example, by depositing coins, or inserting a credit card, debit card or smart card. Thereafter, the player optionally initiates play of the slot machine 300 during step 820, for example, by pressing a starting controller 374 (FIG. 3). According to a feature of the invention, the player receives a menu of the available premium entertainment services during step 830, and makes a selection of a desired premium entertainment service during step 840. Thereafter, the player receives access to the selected premium entertainment service during step 850 for as long as the player complies with the casino-specified criteria for accessing such premium entertainment services, in the manner described above.

It is to be understood that the embodiments and variations shown and described herein are merely illustrative of the principles of this invention and that various modifications may be implemented by those skilled in the art without departing from the scope and spirit of the invention.

We claim:

1. An electronic gaming system for allowing a slot machine player to bet on pseudo-randomized events and being operative to provide said player with access to a premium entertainment service, said electronic gaming system comprising:

means for generating a pseudo-random event for each play of said slot machine;

means for determining a game result based upon said pseudo-random event; and means responsive to the play of said slot machine for initiating access to said premium entertainment service, wherein said means for initiating access initiates access when said player meets a predefined standard.

2. The electronic gaming system according to claim 1, wherein said predefined standard comprises a predefined current level of play.

3. The electronic gaming system according to claim 1, further comprising means for receiving a player identification number identifying said player, said player having a prior playing history, and wherein said predefined standard comprises a minimum prior playing history.

4. The electronic gaming system according to claim 1, wherein said predefined standard comprises a class of electronic gaming systems.

5. The electronic gaming system according to claim 1, wherein said predefined standard comprises a payment.

6. The electronic gaming system according to claim 1, further comprising means for terminating said access to said premium entertainment service if said predefined standard is not met.

7. The electronic gaming system according to claim 1, further comprising means for said player to maintain said access to said premium entertainment service when said predefined standard is not met, said access being maintained when said player provides a payment.

8. The electronic gaming system according to claim 1, further comprising means for said player to maintain said access to said premium entertainment service when said predefined standard is not met by allowing a deduction of earned credits from current play prizes or player reward points.

9. An electronic gaming system for allowing a slot machine player to bet on pseudo-randomized events and being operative to provide said player with access to a premium entertainment service, said electronic gaming system comprising:

means for generating a pseudo-random event for each play of said slot machine;

means for determining a game result based upon said pseudo-random event;

means responsive to the play of said slot machine for initiating access to said premium entertainment service; and means for presenting said player with a menu of available premium entertainment services and for receiving a selection from said player of a desired premium entertainment service.

10. An electronic gaming system for allowing a slot machine player to bet on pseudo-randomized events and being operative to provide said player with access to a premium entertainment service, said electronic gaming system comprising:

means for generating a pseudo-random event for each play of said slot machine;

means for determining a game result based upon said pseudo-random event;

means responsive to the play of said slot machine for initiating access to said premium entertainment service; and means for storing a record of connections made by said electronic gaming system to each premium entertainment service.

11. An electronic gaming system for allowing a slot machine player to bet on pseudo-randomized events and being operative to provide said player with access to a premium entertainment service, said electronic gaming system comprising:

means for generating a pseudo-random event for each play of said slot machine;

means for determining a same result based upon said pseudo-random event; and means responsive to the play of said slot machine for initiating access to said premium entertainment service, wherein said game result and said premium entertainment service arc displayed to said player by means of a virtual reality headset.

12. The electronic gaming system according to claim 2, wherein said current level of play is evaluated based upon at least one of the following criteria: the number of plays in a predefined time period, the amount of money said player has won, the amount of time the player has played or the amount of coins said player started with.

13. An electronic gaming system for allowing a slot machine player to bet on pseudo-randomized events and being operative to provide said player with access to a premium entertainment service, said electronic gaming system comprising:

means for generating a pseudo-random event for each play of said slot machine;

means for determining a game result based upon said pseudo-random event; and means responsive to the play of said slot machine for initiating access to said premium entertainment service, wherein said premium entertainment service is a web site.

14. An electronic gaming system for allowing a slot machine player to bet on pseudo-randomized events and being operative to provide said player with access to a premium entertainment service, said electronic gaming system comprising:

means for venerating a pseudo-random event for each play of said slot machine;

means for determining a game result based upon said pseudo-random event; and means responsive to the play of said slot machine for initiating access to said premium entertainment service, wherein said premium entertainment service is a shared-revenue telephone service.

15. A method for allowing a player to bet on pseudo-randomized events using an electronic gaming device and for providing said player with access to a premium entertainment service, said method comprising:

generating a pseudo-random event for each play of said electronic gaming device;

determining a game result based upon said pseudo-random event; and initiating access to said premium entertainment service responsive to the play of said electronic gaming device, wherein said initiating is performed when said player meets a predefined standard.

16. The method according to claim 15, wherein said predefined standard comprises a predefined current level of play.

17. The method according to claim 15, further comprising receiving a player identification number identifying said player, said player having a prior playing history, and wherein said predefined standard comprises a minimum prior playing history.

18. The method according to claim 15, wherein said predefined standard comprises a class of electronic gaming systems.

19. The method according to claim 15, wherein said predefined standard comprises a payment.

20. The method according to claim 15, further comprising the step of terminating said access to said premium entertainment service if said predefined standard is not met.

21. The method according to claim 15, further comprising the step of permitting said player to maintain said access to said premium entertainment service when said predefined standard is not met, said access being maintained when said player provides a payment.

22. The method according to claim 15, further comprising the step of permitting said player to maintain said access to said premium entertainment service when said predefined standard is not met by allowing a deduction of earned credits from current play prizes or player reward points.

23. A method for allowing a player to bet on pseudo-randomized events using an electronic gaming device and for providing said player with access to a premium entertainment service, said method comprising:

generating a pseudo-random event for each play of said electronic gaming device;

determining a game result based upon said pseudo-random event;

initiating access to said premium entertainment service responsive to the play of said electronic gaming device; and presenting said player with a menu of available premium entertainment services and for receiving a selection from said player of a desired premium entertainment service.

24. A method for allowing a player to bet on pseudo-randomized events using an electronic gaming device and for providing said player with access to a premium entertainment service, said method comprising:

generating a pseudo-random event for each play of said electronic gaming device;

determining a game result based upon said pseudo-random event;

initiating access to said premium entertainment service responsive to the play of said electronic gaming device; and storing a record of connections made by said electronic gaming system to said premium entertainment service.

25. A method for allowing a player to bet on pseudo-randomized events using an electronic gaming device and for providing said player with access to a premium entertainment service, said method comprising:

generating a pseudo-random event for each play of said electronic gaming device;

determining a game result based upon said pseudo-random event;

initiating access to said premium entertainment service responsive to the play of said electronic gaming device; and displaying said game result and said premium entertainment service to said player by means of a virtual reality headset.

26. The method according to claim 16, wherein said current level of play is evaluated based upon at least one of the following criteria: the number of plays in a predefined time period, the amount of money said player has won, the amount of time the player has played or the amount of coins said player started with.

27. A method for allowing a player to bet on pseudo-randomized events using an electronic gaming device and for providing said player with access to a premium entertainment service, said method comprising:

generating a pseudo-random event for each play of said electronic gaming device;

determining, a game result based upon said pseudo-random event; and initiating access to said premium entertainment service responsive to the play of said electronic gaming device, wherein said premium entertainment service is a web site.

28. A method for allowing a player to bet on pseudo-randomized events using an electronic gaming device and for providing said player with access to a premium entertainment service, said method comprising:

generating a pseudo-random event for each play of said electronic gaming device;

determining a game result based upon said pseudo-random event; and initiating access to said premium entertainment service responsive to the play of said electronic gaming device, wherein said premium entertainment service is a shared-revenue telephone service.

29. A gaming machine comprising:

means for receiving a player tracking card;

means for reading a player identification number from said player tracking card;

means for generating a pseudo-random event for each play of said gaming machine;

means for determining a game result based upon said pseudo-random event;

means for awarding incentive points for each play of said gaming machine in an account associated with said player identification number;

means for accessing a premium entertainment service from said gaming machine; and means for deducting incentive points from said account in exchange for accessing said premium entertainment service.

30. A method for accessing a premium entertainment service while playing an electronic gaming device, said method comprising the steps of:

playing said electronic gaming device; and receiving access to said premium entertainment service, responsive to said playing of said electronic gaming device, wherein said step of receiving access to said premium entertainment service is responsive to said playing of said electronic gaming device at a particular level of play.

31. A system for providing access to a premium entertainment service as an incentive for a player playing said electronic gaming device, said system comprising:

a first communications port for receiving information from said electronic gaming device;

a second communications port for establishing a connection to said premium entertainment service; and a controller coupled to said first and second communications ports, said controller adapted to configure said ports to establish said connection between said user and said premium entertainment service responsive to the play of said electronic gaming device, wherein said controller is further adapted to configure said ports to establish said connection when said player meets a predefined standard.

32. The system according to claim 31, wherein said predefined standard comprises a predefined current level of play.

33. The system according to claim 31, wherein said controller is further adapted to receive a player identification number identifying said player, said player having a prior playing history, and wherein the predefined standard comprises a minimum prior playing history.

34. The system according to claim 31, wherein said predefined standard comprises a class of electronic gaming devices.

35. The system according to claim 31 wherein said predefined standard comprises a payment.

36. The system according to claim 31, further comprising means for terminating said access to said premium entertainment service if said predefined standard is not met.

37. The system according to claim 31, wherein said controller is further adapted to maintain said access to said premium entertainment service when said predefined standard is not met, said access being maintained when said player provides a payment.

38. The system according to claim 31, further comprising means for said player to maintain said access to said premium entertainment service when said predefined standard is not met by allowing a deduction of earned credits from current play prizes or player reward points.

39. A medium storing instructions adapted to be executed by a processor to perform a method for allowing a player to bet on pseudo-randomized events using an electronic gaming device and for providing said player with access to a premium entertainment service, said method comprising:

generating a pseudo-random event for each play of said electronic gaming device;

determining a game result based upon said pseudo-random event; and initiating access to said premium entertainment service responsive to the play of said electronic gaming device, wherein said initiating is performed when said player meets a predefined standard.

* * * * *